United States Patent [19]

Bulso, Jr. et al.

[11] 4,248,076

[45] Feb. 3, 1981

[54] TRIPLE ACTION CONTAINER DRAWING AND REDRAWING METHOD

[75] Inventors: Joseph D. Bulso, Jr.; William R. Lewers, both of Canton, Ohio

[73] Assignee: Redicon Corporation, Canton, Ohio

[21] Appl. No.: 136,414

[22] Filed: Apr. 2, 1980

Related U.S. Application Data

[62] Division of Ser. No. 877,292, Feb. 13, 1978, Pat. No. 4,214,471.

[51] Int. Cl.[3] ..... B21D 22/28

[52] U.S. Cl. ..... 72/349; 72/377

[58] Field of Search ..... 72/347, 348, 349, 377; 113/120 H

[56] References Cited

U.S. PATENT DOCUMENTS

| | | | |
|---|---|---|---|
| 2,318,819 | 5/1943 | Verson | 72/349 |
| 3,855,862 | 12/1974 | Moller | 72/349 |
| 3,902,347 | 9/1975 | Ridgway et al. | 72/347 |
| 3,986,382 | 10/1976 | Miller et al. | 72/349 |
| 4,007,620 | 2/1977 | Urban | 72/345 |
| 4,007,621 | 2/1977 | Franel et al. | 72/345 |
| 4,020,670 | 5/1977 | Balso et al. | 72/349 |
| 4,043,169 | 8/1977 | Gorgius et al. | 72/349 |

*Primary Examiner*—Leon Gilden

*Attorney, Agent, or Firm*—Reese Taylor

[57] ABSTRACT

A method and apparatus for forming cup-shaped metal containers from a metal blank by drawing and then redrawing the blank to its finished configuration is disclosed. The method and apparatus is intended for use in a double acting press having inner and outer rams which operate in relatively timed relationship. The means for performing the drawing operation are operatively associated with the outer ram and the means for performing the redrawing operation are carried by the inner ram. The drawing means are pneumatically activated and the redrawing means on the inner ram are telescopically received within the drawing means of the outer ram and carry peripheral radially extending shoulders thereon for engagement with the drawing means so that, for at least a portion of the travel of the inner ram, travel of the drawing means is retarded thereby controlling the timing of the actuation of the drawing means and reducing the stroke of the press required to accomplish the triple action drawing and redrawing function.

3 Claims, 7 Drawing Figures

TRIPLE ACTION CONTAINER DRAWING AND REDRAWING METHOD

RELATED APPLICATIONS

This Application is a divisional application of Applicant's earlier filed, co-pending Application filed Feb. 13, 1978 as Ser. No. 877,292 for Triple Action Container Drawing and Redrawing Apparatus now U.S. Pat. No. 4,214,471.

BACKGROUND OF THE INVENTION

This invention relates, in general, to forming high reduction cup-shaped containers such as two piece cans and in particular relates to method for performing the forming operation with a triple action effect incorporated into a double acting press.

PRIOR ART STATEMENT

In the art of container production, it is known to form containers by utilizing a first forming member which performs what is called the "draw" to preliminarily form a blank of metal into a cup-shaped configuration followed by the utilization of a second forming member to perform what is called the "redraw" operation to reduce the container to its final configuration.

There are a number of prior art patents pertinent to and representative of this general field.

An example is Verson U.S. Pat. No. 2,318,819 which discloses a multiple action punch press die and cushion utilized in a long stroke hydraulic press wherein the punches and dies are moved by a mechanically actuated slide which eventually overcomes hydraulic resistance to permit performance of multiple operations in one press stroke. Certain valving arrangements are provided to selectively reduce the hydraulic resistance to enable the successive drawing operations to take place.

Moller U.S. Pat. No. 3,855,862 discloses a draw and redraw process for producing metal cans and is designed primarily to avoid high stress loading at the juncture of the side and bottom walls. This patent discloses a triple action die and punch assembly wherein the first draw apparatus is mechanically driven by a ram following which the second draw apparatus is also mechanically driven.

Bulso U.S. Pat. No. 4,020,670 also discloses a triple action press wherein the first draw is completely controlled mechanically by the outer ram as is the hold-down pressure for the second draw.

Franek U.S. Pat. No. 4,007,621 is of general interest in that it discloses a single draw apparatus for forming hollow articles of the general nature referred to herein.

Miller U.S. Pat. No. 3,986,382 discloses a means for ironing a seamless can and operates in a horizontal mode.

Urban U.S. Pat. No. 4,007,620 also operates in a horizontal mode and discloses mechanism for drawing and redrawing a container with the drawing and redrawing means being operated by a mechanical linkage.

Gorgius U.S. Pat. No. 4,043,169 also discloses a cupping tool for use in a double acting press to perform blanking, drawing and redrawing operations in a predetermined timing sequence. This reference is primarily characterized in the utilization of a camming arrangement which, in turn, activates a latch mechanism between the draw and redraw punches.

While the aforementioned prior art devices are presumed effective for the purposes for which they are designed, it has been found that it is desirable to provide a triple action apparatus for drawing a container which can be placed into conventional existing presses without any serious modification thereof. It has also been found desirable to avoid the mechanically controlled metal-to-metal type contact involved in the hold down operation during the draw and redraw operation.

SUMMARY OF THE INVENTION

It has been discovered, therefore, that these objectives can be accomplished and such apparatus can be provided that is suitable for use in existing conventional presses. Such a press can be seen for example in Ridgway U.S. Pat. No. 3,902,347 which discloses a mechanical press having inner and outer slides or rams which are connected and operated by a crank shaft with a pair of offset cranks which provide timed spacing between the operation of the inner and outer rams. The present invention is intended to be utilized with a press of this general nature although its usage is not necessarily limited to the precise structure illustrated in the Ridgway patent.

In order to accomplish the object of the invention set forth above, it has been discovered that improved results can be achieved by apparatus in which the first draw means are operatively connected to the outer ram while the second or redraw means are operatively connected to the inner ram.

It has also been found advantageous to employ pneumatic pressure to effectuate the various hold down functions during both drawing operations.

Furthermore, in view of the fact that the outer ram travels ahead of the inner ram and in order to minimize the length of ram travel necessary, it has been found advantageous to provide interconnecting means carried by the redraw apparatus and the inner ram to impede the motion of the drawing means of the out ram and thereby the motion of the drawing horn for at least a predetermined portion of the travel of the inner ram.

It has been found that by such a provision the effectiveness of the pneumatic operation is essentially enhanced while the length of the stroke is greatly reduced.

Accordingly, production of improved triple action drawing and redrawing method and apparatus of the character abovedescribed becomes the principal object of this invention with other objects thereof becoming more apparent upon a reading of the following brief specification considered and interpreted in view of the accompanying drawings.

OF THE DRAWINGS

BRIEF DESCRIPTION OF THE PREFERRED EMBODIMENTS

It will be first noted that the apparatus disclosed herein is intended for use in a double acting press which includes a crank shaft with a pair of offset cranks or similar actuating apparatus adapted to provide proper timed spacing between the operation of an inner and outer ram assemblies. One type of double acting press having such features, which are known in the art, is illustrated in Ridgway U.S. Pat. No. 3,902,347. Therefore, the detailed press structure has not been illustrated herein with it being understood that the apparatus that is disclosed is capable of being installed and used in existing presses of this general nature which are well known in the container forming industry.

Figure 1:
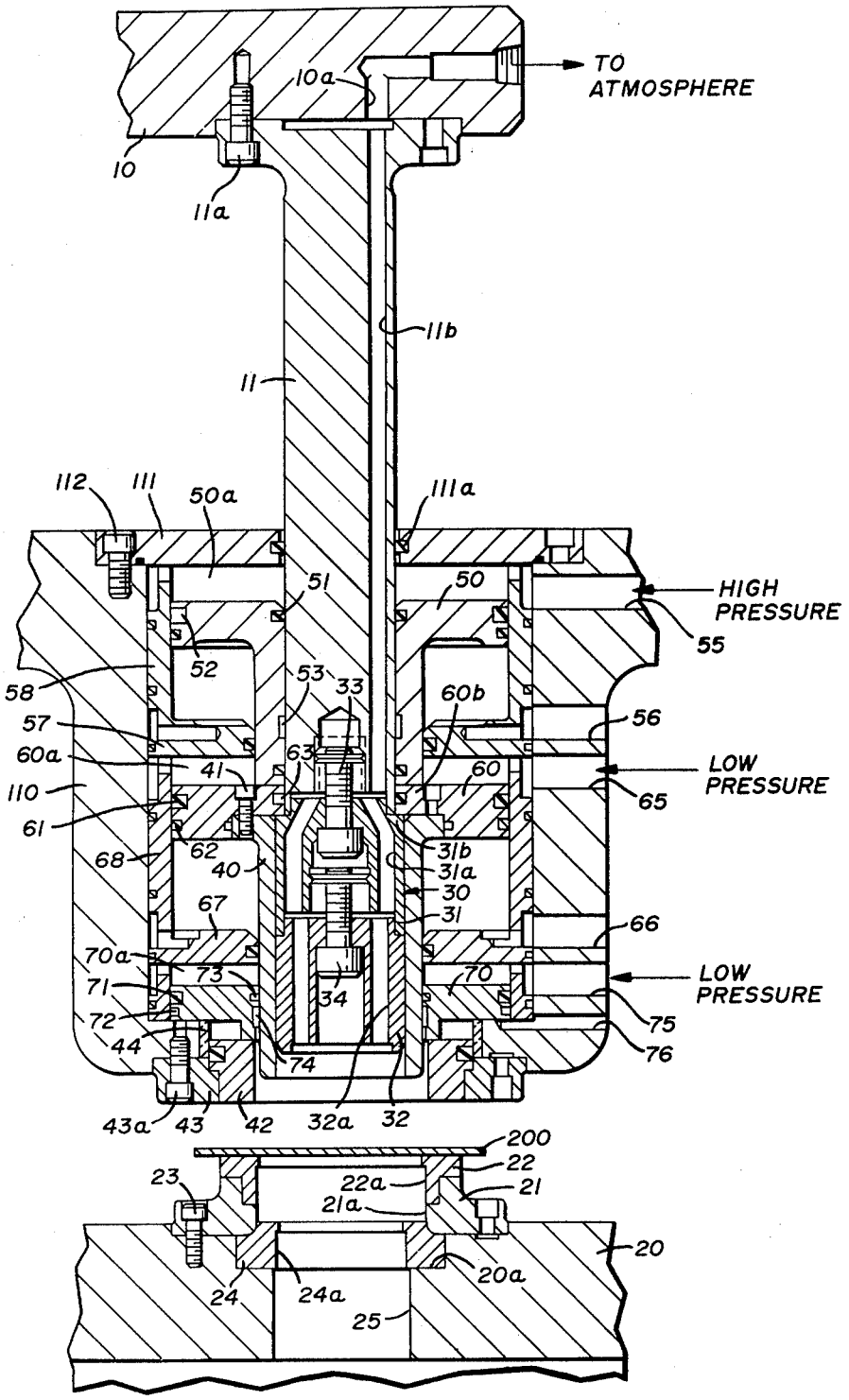
FIG. 1 is a sectional view, partially schematic, of the draw, redraw and die components of the improved apparatus with the blank introduced into the press and with the press in the open condition.

Turning then to FIG. 1 of the drawings, it will be noted that the main components of the improved apparatus include the inner ram punch holder 10, the outer ram punch holder 110 and the bottom bolster 20. It will be understood that punch holders 10 and 110 will be secured to the inner and outer rams of a double acting press of the type already described for movement therewith and actuation thereby in conventional fashion.

Still referring to FIG. 1 and considering first the bottom bolster or bed 20, it will be noted that this bolster has secured to its upper face a matrix 21 which is held in place by screws 23 and carries, on its top surface, a draw die 22. Only one screw 23 is shown but it is understood that a plurality would be used as required.

These components (the matrix 21 and die 22) are annular in nature and have axially aligned, through central bores 21*a* and 22*a* of a suitable size for accomodating the container during the drawing operation.

Also received in an undercut area 20*a* of the top surface of bottom bolster 20 is a redraw die 24 which is effectively held in place by the fact that the matrix 21 overlies a portion of its upper surface. The redraw die 24 also has a through central aperture 24*a* which is smaller than that of the draw die 22 and is sized so as to accomodate the container during the redraw operation.

Coaxially aligned with the central apertures 22*a* and 24*a* of the draw die 22 and redraw die 24 is a through bore 25 in the bottom bolster 20. This bore provides room for reception of the drawn and redrawn container and also provides access for a knockout assembly of conventional nature, if used (not shown). This bore also permits the container to be removed by pneumatic blow-off if desired.

Turning next then to the structure associated with the inner ram, it will be noted that the inner ram punch holder 10 has secured to it an elongate cylindrical riser 11 which is secured thereto at its upper end by means of suitable screws 11*a*, only one of which is shown. The riser 11 is elongate in nature and has an axially extending through passageway 11*b* leading ultimately to the atmosphere for venting purposes or for pneumatic blow-off of the finished container as required. It will be noted that the inner ram punch holder 10 also has a passageway 10*a* which is in communication with the passageway 11*b* so that venting from the container to the atmosphere and/or pneumatic blow-off can be accomplished as will be described.

At the bottom or lower end of the riser 11, a redraw horn assembly, generally designated by the numeral 30, is disposed. This assembly includes a cylindrical redraw horn carrier 31 and the actual cylindrical forming horn 32. Both of these components have through passageways, respectively 31*a* and 32*a*, which ultimately are placed into fluid communication with bore 11*b* in the riser for venting or blow-off purposes.

The redraw horn carrier 31 is secured to the lower end of the riser 11 by means of screw 33 and in similar fashion the actual forming horn 32 is secured to the carrier 31 by means of screw 34.

It should also be noted that the horn support 31 terminates in a radially offset shoulder 31*b* adjacent its top end and the cooperation of this shoulder with other components is significant to the invention and will be described in detail below.

Turning next then to the outer ram punch holder 110, it will be noted that a cover plate 111 is secured to the top thereof by screws 112 and is sealed with respect to riser 11 by the seal 111*a*. This punch holder 110 is effectively mounted in surrounding relationship to the riser 11 and redraw horn assembly 30 for relative movement along the longitudinal axis thereof as will be described.

Outer ram punch holder 110 also includes a number of additional components.

First, a first cylindrical pressure piston 50 is disposed within a pressure chamber 50*a* with appropriate seals 51, 52 and 53 serving to ensure relative fluid tight engagement with the riser 11, which it surrounds, and the wall liner 58. Furthermore, a port or passageway 55 is connected to a relatively high pressure pneumatic source so that pressure supplied through the line 55 will be capable of acting on the top of the piston 50. The first pressure piston 50 operates within a pressure chamber 50*a*, as noted, and that chamber also includes a bottom wall 57 which is in communication with an exhaust vent 56. This chamber 50*a* is formed by bottom wall 57, the periphery of riser 11, the bottom of cover plate 111 and liner 58.

A second cylindrical pressure piston 60 is also provided beneath first pressure piston 50 and is also disposed in surrounding relationship to the riser 11 and redraw horn assembly 30. This piston 60 also has a plurality of seals 61, 62 and 63 and is disposed within a pressure chamber 60*a*. Again, the pressure chamber 60*a* is in communication with a source of relatively low pressure pneumatic pressure by means of the passageway 65. Pressure chamber 60*a* also has a bottom wall 67 and a vent port 66. Thus chamber 60*a* is formed by bottom wall 67, the periphery of riser carrier 31, bottom wall 67 and liner 68.

Attached to the second pressure piston 60 is the cylindrical draw sleeve or horn 40 which is secured thereto by the screws 41 and is capable of travel with piston 60 relatively of the redraw horn assembly 30.

It should be noted at this point that the second pressure piston 60 has an inwardly extending shoulder area 60*b* which, in FIG. 1, is shown in overlying relationship with both the top of the draw horn 40 and the shoulder 31*b* on the redraw horn support 31.

A third pressure piston 70 is also carried by the punch holder 110 beneath second pressure piston 60 and is disposed within a pressure chamber 70*a*. Again, suitable seals 71, 72, 73 and 74 are provided and port 75 provides access to relatively low pressure pneumatic pressure which can act on the top of the piston 70. Finally, a venting port 76 is also provided.

Beneath the third pressure piston 70 is a draw pressure pad 42 which, in the position of the parts illustrated in FIG. 1, has its top surface in contact with the bottom surface of piston 70. This draw pressure pad is movable vertically within the chamber 70*a*.

Also secured to the outer punch holder 110 adjacent its bottom end is a blanking ring 43 secured in place by the screw 43*a* and having the wear sleeve 44 interposed between the bottom of piston 70 and the top of the blanking ring 43.

In describing the operation of the improved apparatus, reference will be made to the sectional views of FIGS. 1 through 6 to illustrate the steps of operation. In all instances, however, reference should also be had to FIG. 7 showing a typical cyclical arrangement and the position of the inner and outer rams in response to the position of the cranks on the press at any given stage of the operation. In this regard it will be noted that the outer ram runs ahead of the inner ram.

Accordingly then, and referring again to FIG. 1, it will be noted that the press apparatus is essentially in an "Open" position with the outer ram being at the top of its stroke and with the blank 200 being inserted into the press on top of draw die 22 by conventional feed means. At this time, the outer ram and outer ram punch holder 110 are moving in a downward direction and the inner ram structure is about to begin such movement. At this time, also, the relatively high pneumatic pressure already referred to is being injected into the outer ram housing through the line 55 to act on the top of first pressure piston 50.

Figure 2:
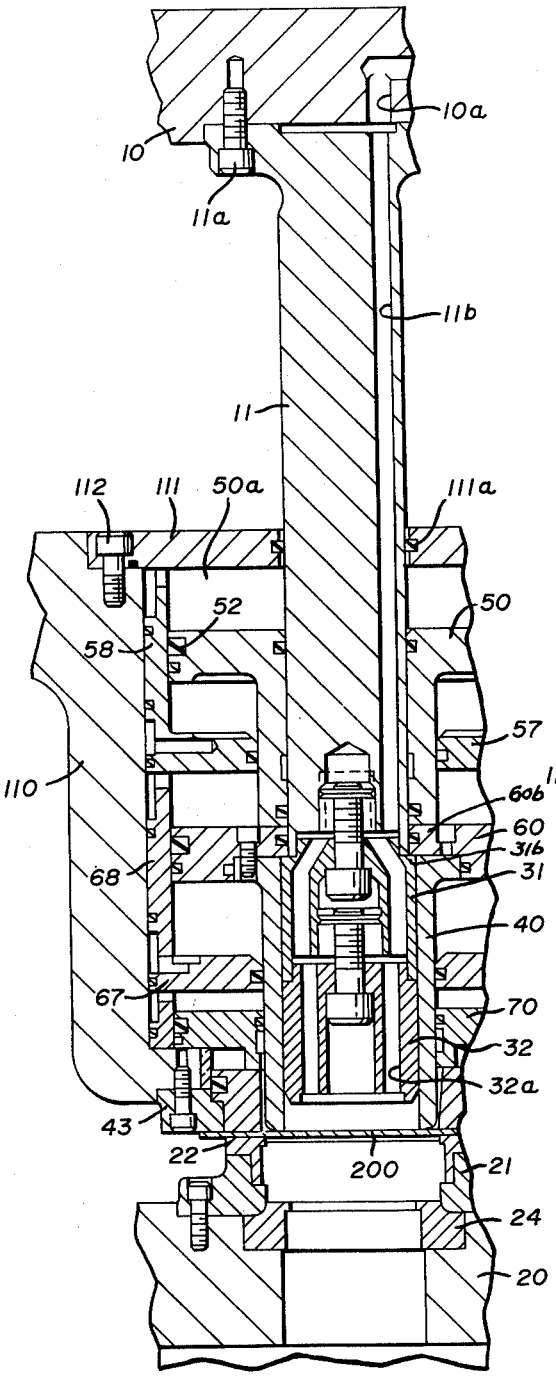
FIG. 2 is a sectional view similar to FIG. 1 showing the press closed to the die line.

Turning to FIG. 2, the outer ram will now have traveled to approximately the 316° position and the outer ram punch holder 110 has closed to the "die line" position. At this time, the draw pressure pad 42 is in contact with the blank 200 and is kept in such contact by the above noted relatively low pneumatic pressure through the line 75 acting on piston 70 to provide the necessary hold down pressure.

The inner ram has, of course, also continued its downward movement and it should be noted at this juncture that shoulder 31*b* and shoulder portion 60*b* of horn support 31 and piston 60 respectively are in contact. Effectively, the inner ram by virtue of this contact is tending to retard the movement of piston 60 and draw horn 40 which is carried by outer punch holder 110 notwithstanding the fact that the outer ram and outer ram housing are ahead in the operating cycle.

Figure 3:
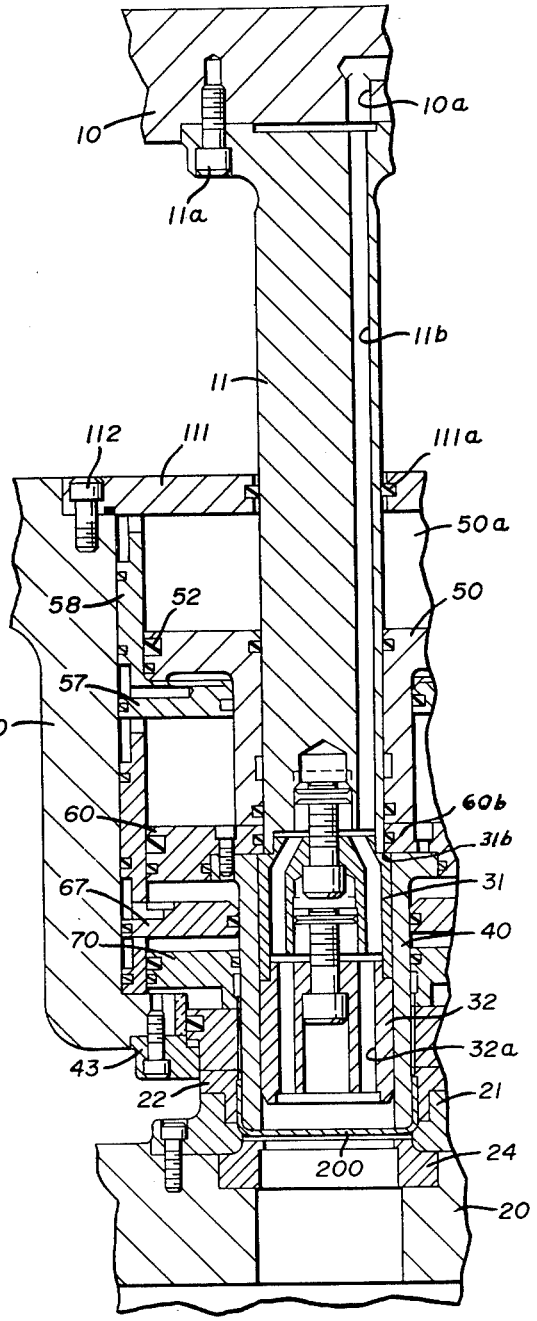
FIG. 3 is a sectional view similar to FIG. 1 showing the apparatus near the completion of the first draw operation.

Turning to FIG. 3, it will be noted that just before the first draw is made the blanking ring 43 is moved down with punch holder 110 to sever excess material. Further movement causes the first draw to be made and the outer ram is at approximately the 336° position. At this point the relatively high pneumatic pressure injected through line 55 and operating on first pressure piston 50 forces it downward. This piston, being in engagement with piston 60, likewise forces that piston downward and effectively forces the drawing horn 40 which is secured to piston 60 into the cavity of draw die 22 forming the metal 200 to the shape shown in FIG. 3.

Figure 4:
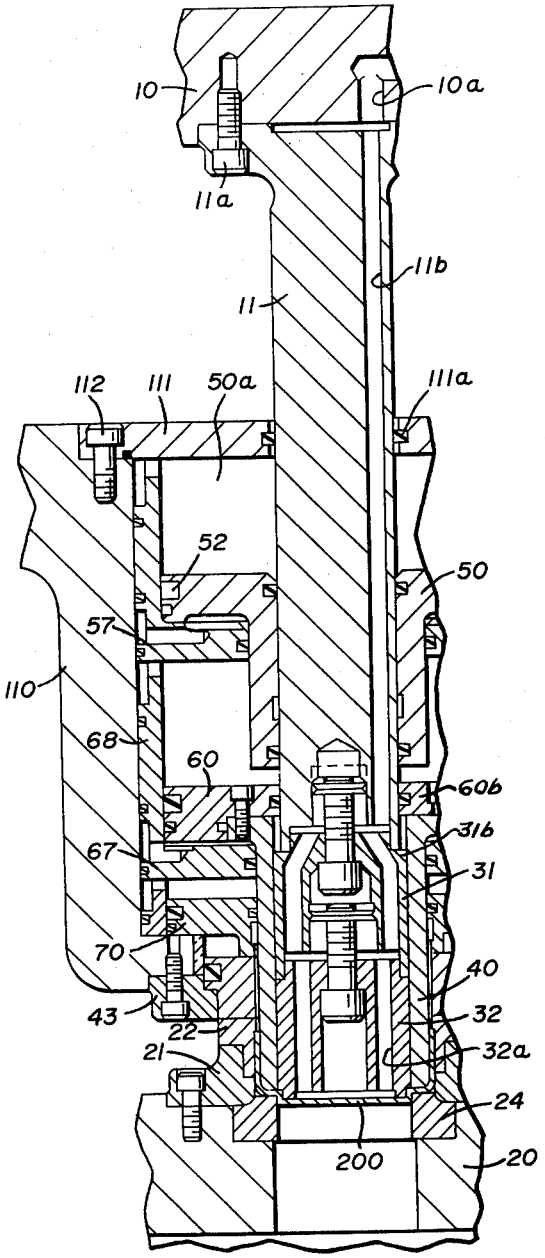
FIG. 4 is a sectional view similar to FIG. 1 showing the apparatus at the start of the redraw operation.

Turning to FIG. 4, pneumatic pressure on the first pressure piston 50 will have been relieved at this point by suitable timing means and the piston has bottomed on bottom wall 57 of pressure chamber 50*a*. This figure shows the start of the redraw operation with the outer ram at about the 356° point. It should be noted that the low pressure entering through port 65 and acting on second pressure piston 60 is still operational as is the low pressure through the port 75 acting on third pressure piston 70.

At the same time, the inner ram has, of course, continued its downward movement and riser 11 has been forced downward as has the redraw horn 32 which, in FIG. 4, is shown as just beginning to operate on the drawn cup 200 to perform the redraw operation.

At this time, shoulder 31*b* of horn support 31 and shoulder portion 60*b* of second pressure piston 60 have separated and the outer ram has effectively stopped its downward movement. However, the piston 60 and the low pressure thereon is sufficient to accomplish the hold down function as required by the draw horn 40 itself.

Figure 5:
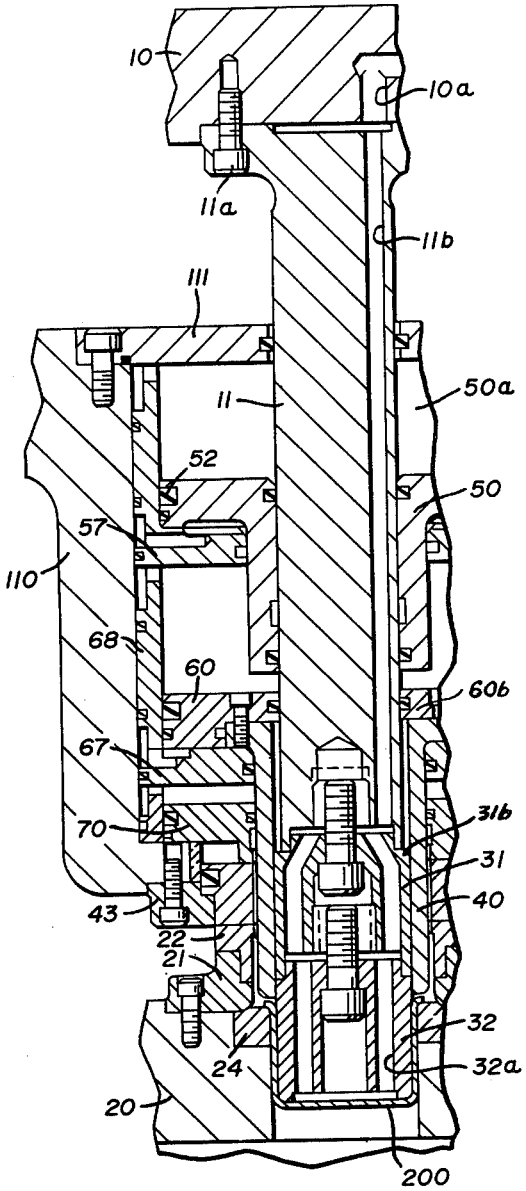
FIG. 5 is a sectional view similar to FIG. 1 showing the apparatus near the completion of the redraw operation and with lift off having begun.

Referring then to FIG. 5 it will be noted that the redraw operation has been almost completed and the outer ram is at about the 40° point, or in other words, just beginning to lift off. It will be noted that the horn 40 has just begun to lift which is acceptable because the hold down function is no longer required during completion of the redraw. The riser 11 and, of course, the inner ram structure is approaching bottom dead center at this point.

Figure 6:
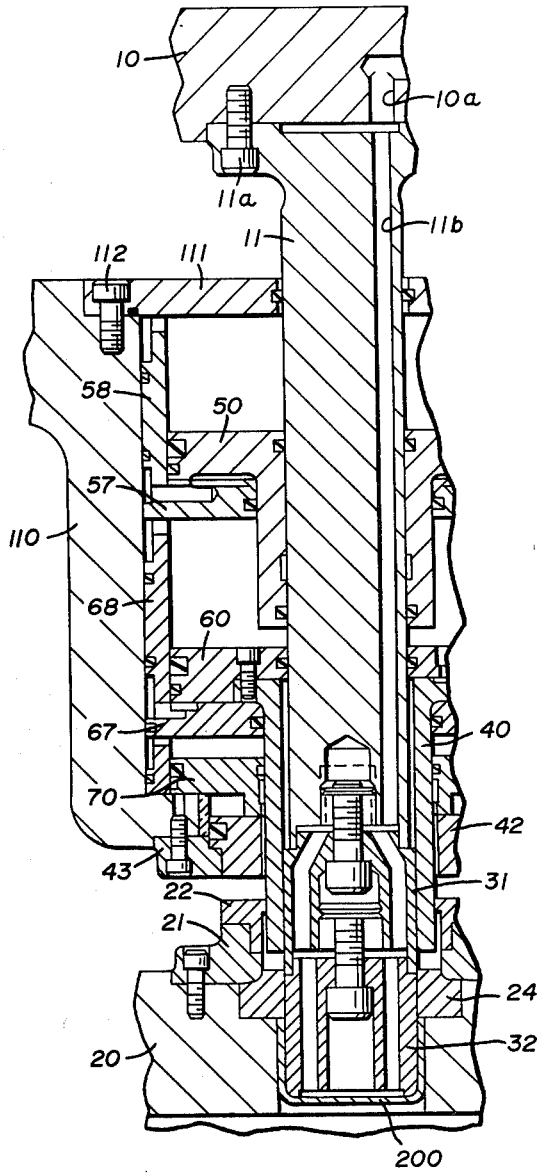
FIG. 6 is a sectional view showing the apparatus at the completion of the redraw operation.
Figure 7:
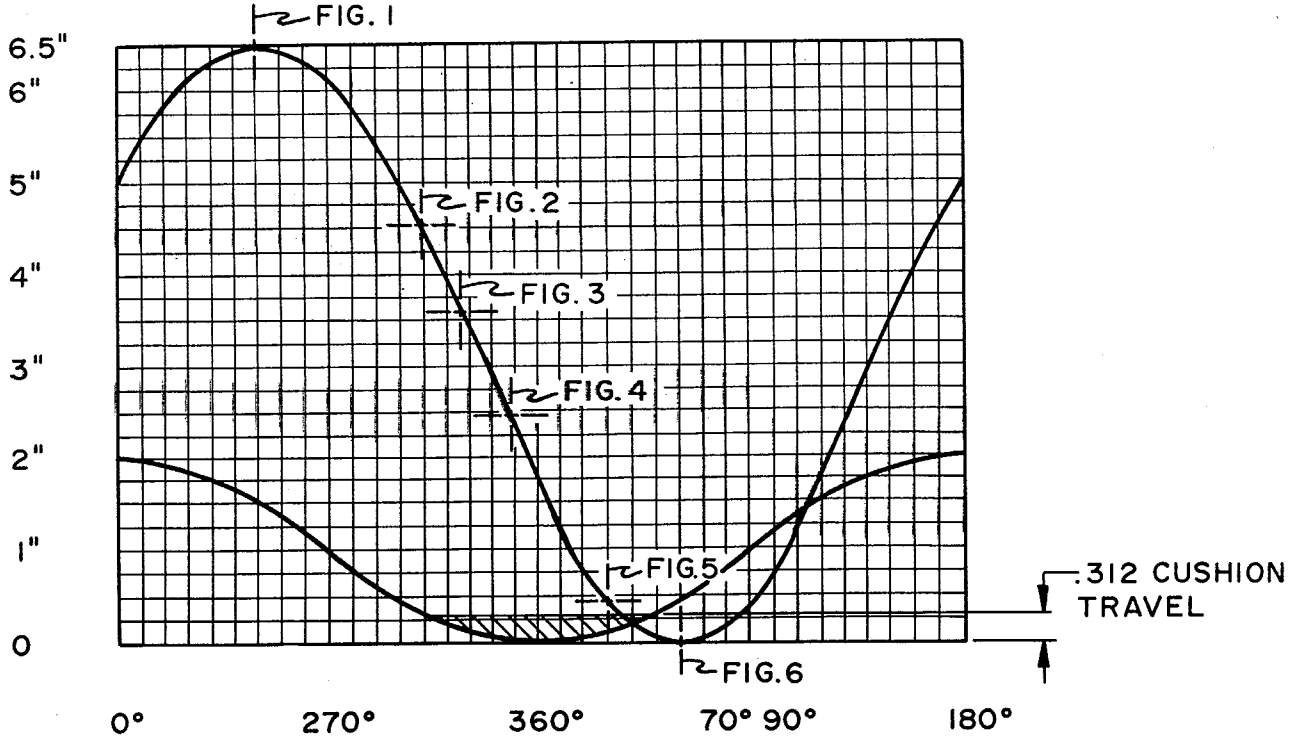
FIG. 7 is a chart illustrating the positions of the apparatus throughout a complete 360° cycle of operation and illustrating the relative positions of the inner and outer rams.

FIG. 6 illustrates the inner ram assembly completely at the bottom point and the outer ram assembly pulling away from the bottom bolster 20. This movement also lifts the draw sleeve or horn 40 away fom the bolster 20. Continuing movement of the inner and outer ram will return the components to the position of FIG. 1 at which time knockout apparatus, or such other apparatus as is employed, such as a pneumatic blow-out, can be activated to remove the finished container 200 from the die cavity. Also, as horn 30 is withdrawn the vent system formed by passageways 32*a*, 31*a*, 11*b* and 10*a* prevents collapse of the container.

It should be noted that this type of operation, in contrast to Applicant's earlier U.S. Pat. No. 4,020,670, permits the assembly to be utilized in an existing press. The triple action mechanism illustrated in U.S. Pat. No. 4,020,670 essentially required a minimum $4\frac{1}{2}''$ stroke by the outer crank or ram. Most conventional presses do not provide for this length of a stroke. The present invention, as will be seen with reference to FIG. 7, enables existing presses to be retrofitted or modified to accept the apparatus disclosed herein and only an approximate $2\frac{1}{4}''$ stroke is required for the outer ram.

Furthermore, the entire operation herein is essentially pneumatically controlled for improved performance capabilities.

Finally, it should be noted that until the components reach the positions illustrated in FIG. 4, the inner ram, by operation of the shoulder 31*b* against the bottom of the shoulder portion 60*b* of second pressure piston 60 effectively is retarding movement of the draw horn. However, once the position of FIG. 4 is achieved and the high pressure pneumatic source is cut off from the piston 50, the parts are enabled to separate and the redraw horn 31 is permitted to accomplish its function.

While a full and complete description of the invention has been set forth in accordance with the dictates of the Patent Statutes, it should be understood that modifications can be resorted to without departing from the spirit hereof or the scope of the appended claims.

What is claimed is:

1. A method of drawing and redrawing containers in a double acting press having inner and outer rams operating in relatively timed reciprocal fashion with the outer ram preceding the inner ram in the operating cycle comprising the steps of:

(A) advancing the inner and outer rams toward the container material;

(B) applying relatively high pneumatic pressure to a pressure piston carried by the outer ram;

(C) applying relatively low pneumatic pressure to a further pressure piston and urging said piston into holding contact with the container material;

(D) retarding movement of drawing means carried by the outer ram by engagement there with by redrawing means carried by the inner ram;

(E) blanking the container material;

(F) moving said pressure piston into contact with the drawing means under relatively high pneumatic pressure and drawing the container material;

(G) relieving the relatively high pneumatic pressure on said pressure piston;

(H) applying relatively low pneumatic pressure to the drawing means to hold the drawn container; and (I) advancing the redrawing means to redraw the container.

2. The method of claim 1 further characterized by the step of:

(A) interposing a still further pressure piston carried by the outer ram between said first pressure piston and the drawing means;

(B) said first pressure piston acting on said still further pressure piston and said still further pressure piston acting on the drawing means under relatively high pneumatic pressure until the container material is drawn;

(C) said still further pressure piston acting on the drawing means under relatively low pneumatic pressure until the container is redrawn.

3. The method of claim 2 further characterized by the step of:

(A) engaging said still further pressure piston with the redrawing means until the relatively high pneumatic pressure is relieved from said pressure piston.

* * * * *